US007578218B2

(12) United States Patent
Hood et al.

(10) Patent No.: US 7,578,218 B2
(45) Date of Patent: Aug. 25, 2009

(54) JAR OPENER

(75) Inventors: Lance Logan Hood, Seattle, WA (US); Yiu Chung Wan, Hong Kong (CN)

(73) Assignee: Kwok Kuen So, Hong Kong SAR (CN)

( * ) Notice: Subject to any disclaimer, the term of this patent is extended or adjusted under 35 U.S.C. 154(b) by 0 days.

(21) Appl. No.: 11/780,680

(22) Filed: Jul. 20, 2007

(65) Prior Publication Data

US 2008/0083302 A1 Apr. 10, 2008

(30) Foreign Application Priority Data

Oct. 10, 2006 (EP) ..... 06255212

(51) Int. Cl.
*B67B 7/14* (2006.01)
*B67B 7/02* (2006.01)

(52) U.S. Cl. ..... 81/3.44; 81/304; 81/426

(58) Field of Classification Search ..... 81/3.44, 81/3.4, 3.36, 416–419, 424.5, 426, 426.5, 81/304, 307, 308
See application file for complete search history.

(56) References Cited

U.S. PATENT DOCUMENTS

| | | | | | |
|---|---|---|---|---|---|
| 888,710 | A * | 5/1908 | Janeway | ..... | 81/3.44 |
| 1,641,152 | A | 9/1927 | Burleigh | | |
| 2,082,699 | A | 6/1937 | Keppinger | | |
| 2,750,826 | A * | 6/1956 | Lisbon | ..... | 81/337 |
| 3,134,281 | A * | 5/1964 | Mint | ..... | 81/3.44 |
| 5,531,141 | A * | 7/1996 | Gilbert, Jr. | ..... | 81/426.5 |
| 5,595,094 | A * | 1/1997 | Negus | ..... | 81/3.44 |

* cited by examiner

*Primary Examiner*—Hadi Shakeri
(74) *Attorney, Agent, or Firm*—Leydig, Voit & Mayer, Ltd.

(57) ABSTRACT

A jar opener comprises a pair of handles, a pivot connecting the handles for pivotal movement, and a head section having a pair of jaws extending from the pivot opposite the handles and pivotable by the handles to close for gripping a lid of a jar and to open to release the lid. The jaws have a pair of inner gripping portions adjacent the pivot for gripping a lid of a relatively larger diameter, and a pair of outer gripping portions adjacent the inner gripping portions and further from the pivot than the inner gripping portion for gripping a smaller lid or bottle cap.

4 Claims, 7 Drawing Sheets

JAR OPENER

BACKGROUND OF INVENTION

Jar openers are popular in kitchens for opening the lid of a jar or the cap of a bottle. Many designs have been proposed or utilized in actual products, but very few of them are found to be satisfactory in terms of ease of use, or they can only be used on lids of a narrow range of sizes.

The invention seeks to provide a new or otherwise improved jar opener.

SUMMARY OF THE INVENTION

According to the invention, there is provided a jar opener comprising a pair of handles, a pivot connecting the handles for pivotal movement relative to each other, and a head section comprising a pair of jaws extending from the pivot opposite the handles and pivotable by the handles respectively to close for gripping a lid of a jar and to open for releasing a said lid. The jaws have a pair of inner gripping portions adjacent the pivot for gripping a said lid of a relatively larger diameter, and a pair of outer gripping portions adjacent the inner gripping portions and away from the pivot for gripping a said lid of a relatively smaller diameter.

Preferably, the inner gripping portions have respective concave profiles facing each other.

Preferably, the outer gripping portions have two parts on a first of the two jaws and one part on the second jaw facing in a direction halfway between the said two parts, together providing a non-obtuse triangular three-point grip.

More preferably, the two parts of the outer gripping portions on the first jaw are positioned in a V-shaped arrangement.

More preferably, each of the two parts of the outer gripping portions on the first jaw has a convex profile.

More preferably, the one part of the outer gripping portions on the second jaw has a convex profile.

It is preferred that the inner gripping portions have respective concave profiles facing each other.

It is further preferred that one of the two parts of the outer gripping portions on the first jaw adjoins an outer end of the concave profile of the inner gripping portion on the same jaw.

It is further preferred that the one part of the outer gripping portions on the second jaw adjoins an outer end of the concave profile of the inner gripping portion on the same jaw.

Advantageously, each of the inner and outer gripping portions has a serrated edge for enhanced gripping.

In a preferred embodiment, the jar opener includes a locking mechanism acting between the two handles for locking the two handles as close as possible to thereby maintain grip of the two jaws upon a said lid, the locking mechanism being releasable.

More preferably, the locking mechanism comprises a first member fixed relative to a first of the handle and a second member movably supported by the second handle and spring-loaded to engage upon the first member, the two members being inter-lockable through a ratchet action in a single direction against the two handles pivoting apart.

Further more preferably, the second member of the locking mechanism is accessible for depression to disengage from the first member, thereby releasing the locking mechanism.

More preferably, the two handles are resiliently biased to pivot apart.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
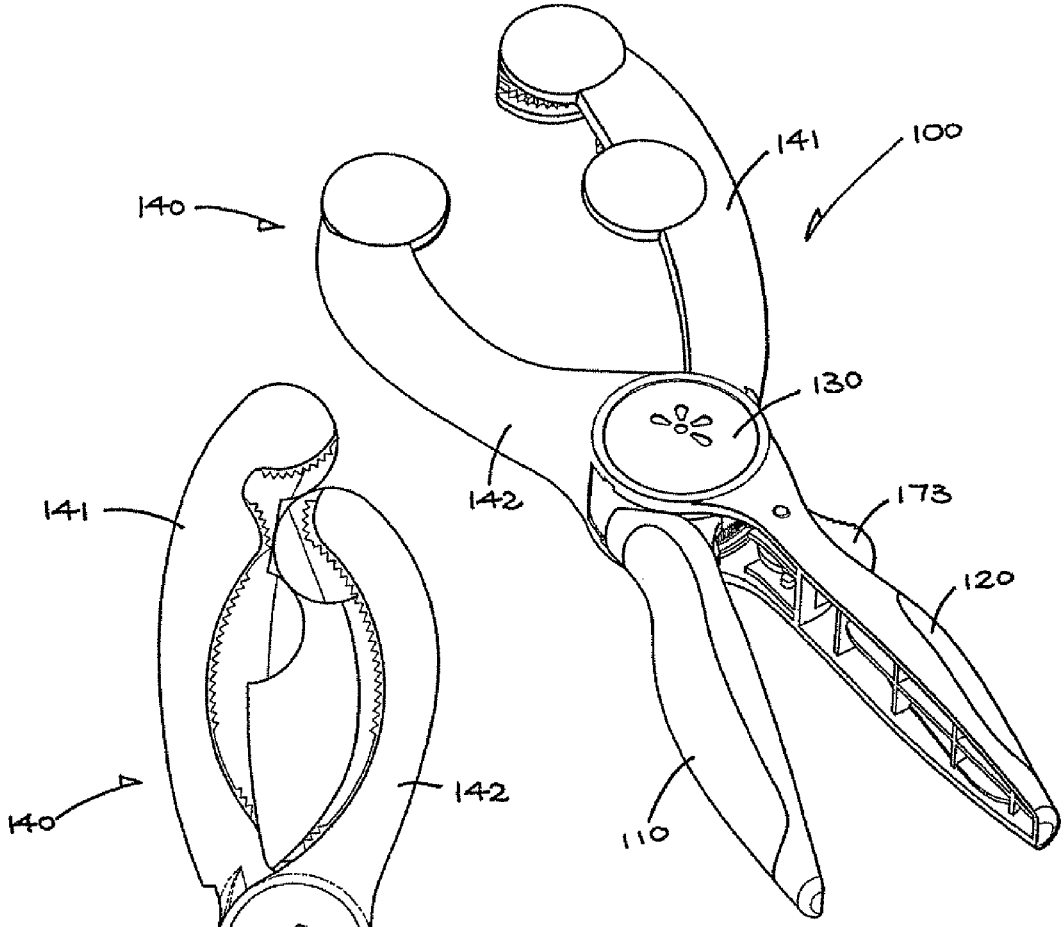
FIG. 1 is a perspective view of an embodiment of a jar opener in accordance with the invention.

Referring to the drawings, there is shown a jar opener 100 embodying the invention, which comprises a pair of plastic elongate handles 110 and 120, a pivot 130 connecting the handles 110 and 120 by their adjacent ends for pivotal movement relative to each other, and a head section 140 extending from one side of the pivot 130 opposite to that of the handles 110 and 120 for engaging a lid of a jar. With its head section 140 engaging the lid, the jar opener 100 may be turned like a wrench to loosen the lid for unscrewing from the body of the jar.

The head section 140 is in the form of a pair of claws having respective plastic arcuate casings 141 and 142 which are provided as integral extensions of the handles 110 and 120 from their pivoted ends respectively. Inside the casings 141 and 142 there are located individual metal jaws 150 and 160, each having one or more serrated edges, for gripping a lid, cap or the like.

The claw casings 141 and 142 have respective walls on one side that are shaped to just expose the gripping edges of the jaws 150 and 160 for operation. Their opposite side walls are relatively wider inwardly, protruding like flanges that act as a support for the jar opener 100 to bear on the lid/cap while the lid/cap is being clamped between the jaws 150 and 160, thereby positioning and stabilizing the jar opener 100 on the lid/cap (FIGS. 9 to 12).

Figure 2:
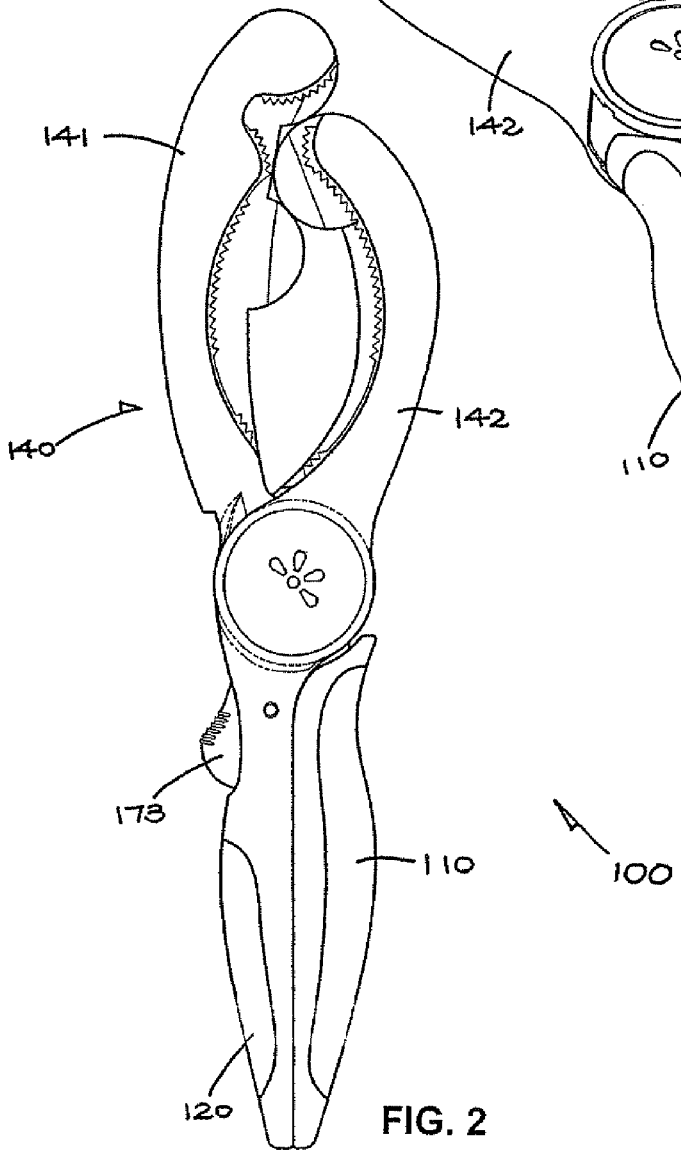
FIG. 2 is a plan view of the jar opener of FIG. 1.
Figure 3:
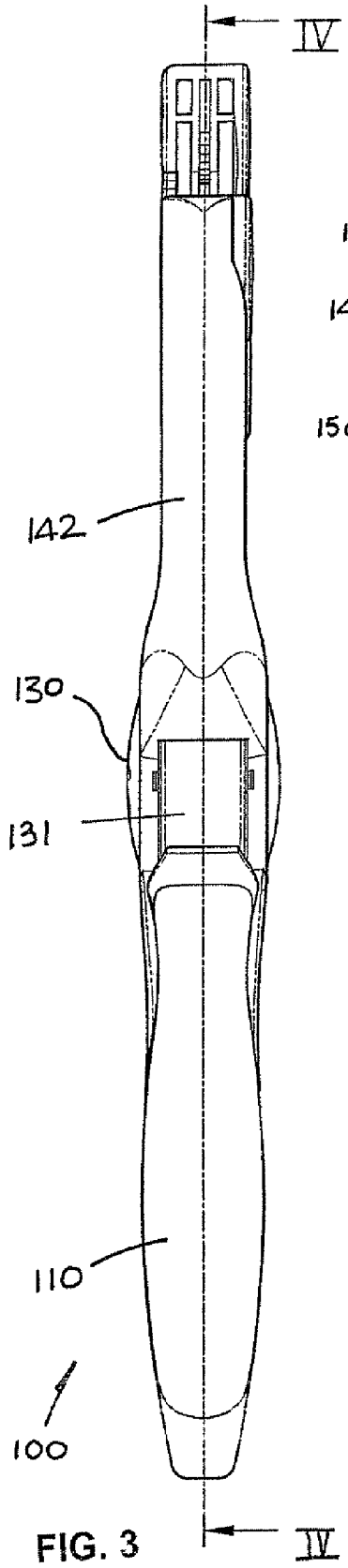
FIG. 3 is a side view of the jar opener of FIG. 1.
Figure 4:
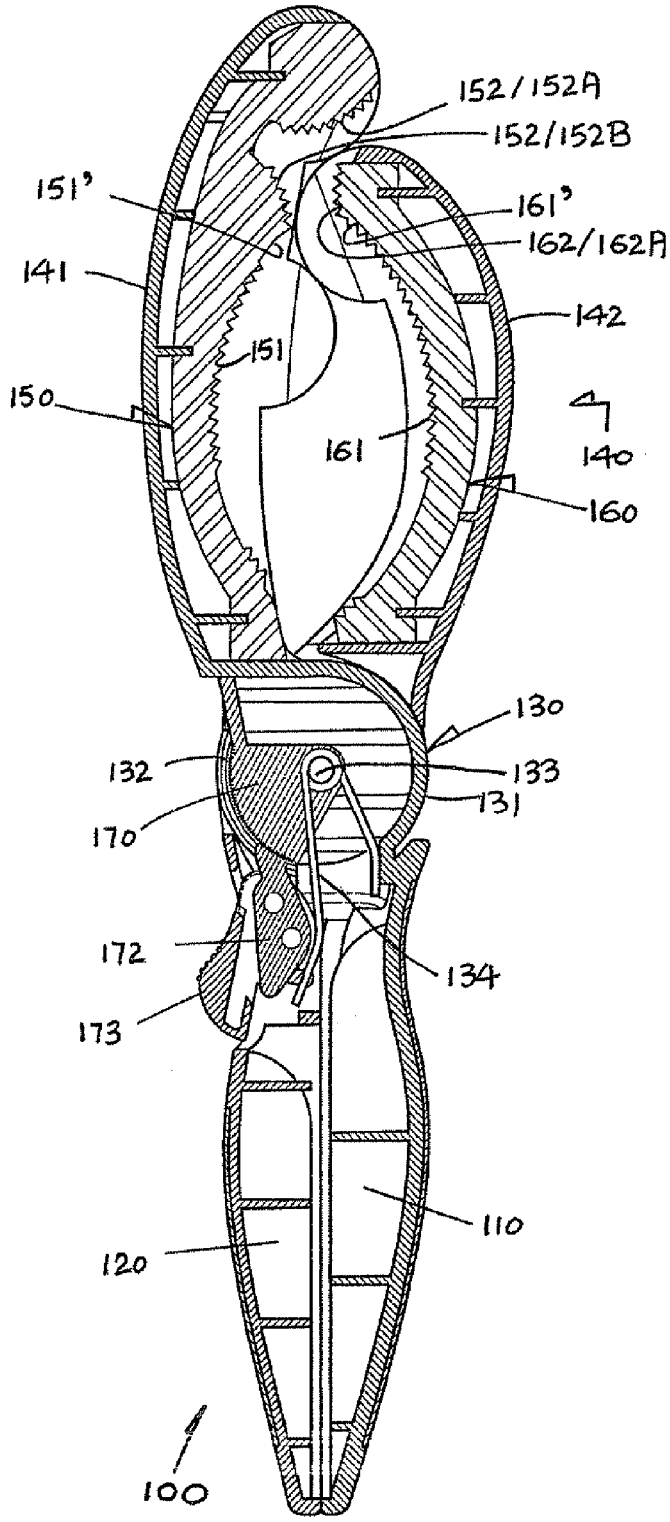
FIG. 4 is a cross-sectional view of the jar opener of FIG. 3, taken along line IV-IV.
Figure 5:
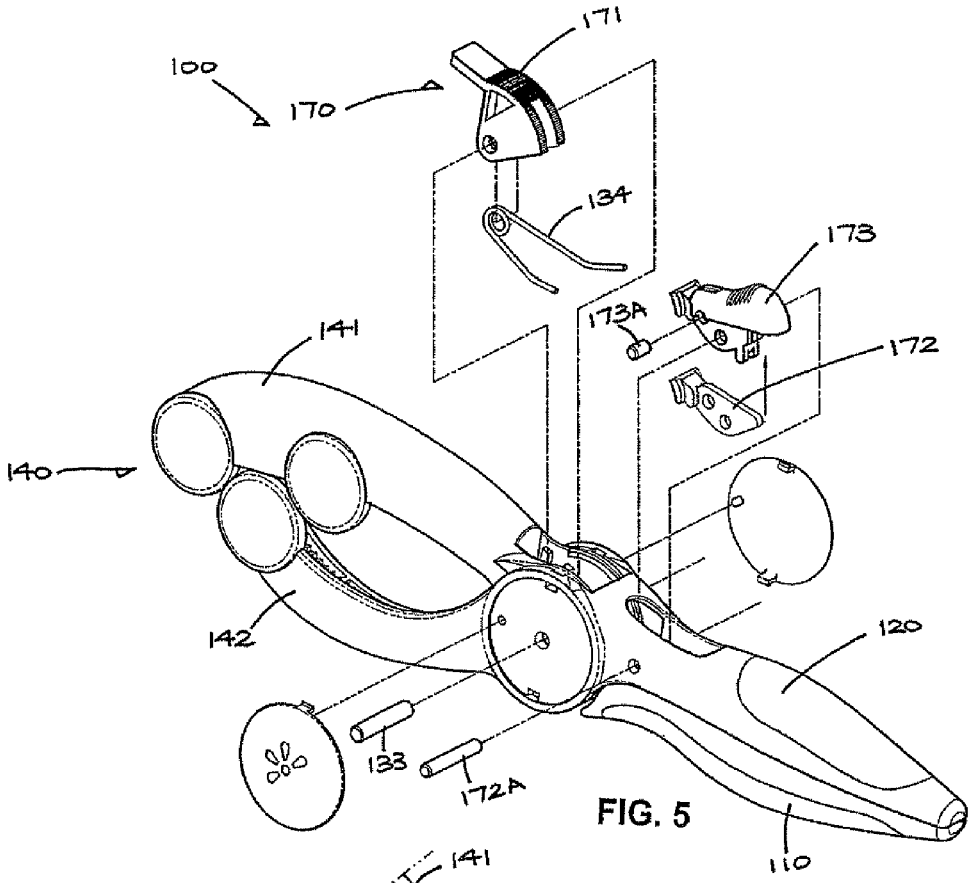
FIG. 5 is a partially exploded perspective view of the jar opener of FIG. 1.

In the position of FIGS. 2 and 4, the left claw casing 141 is integrally jointed with the right handle 110 together forming a first elongate body half 110/141, and the right claw casing 142 with the left handle 120 together forming a second elongate body half 120/142. These two body halves cross each other and are hinged at the pivot 130 such that the jaws 150 and 160 in the claw casings 141 and 142 are pivotable by the handles 110 and 120 respectively, like a pair of pliers, to close for gripping a lid and to open to release the lid.

Hollow part-cylindrical pivot formations 131 and 132 at about mid-length of the two body halves 110/141 and 120/142 are inter-connected by a pivot pin 133, together forming the pivot 130. An internal elbow spring 134 disposed about the pivot pin 133 resiliently biases the two handles 119 and 120 and hence also the two jaws 150 and 160 to normally pivot apart.

Figure 6:
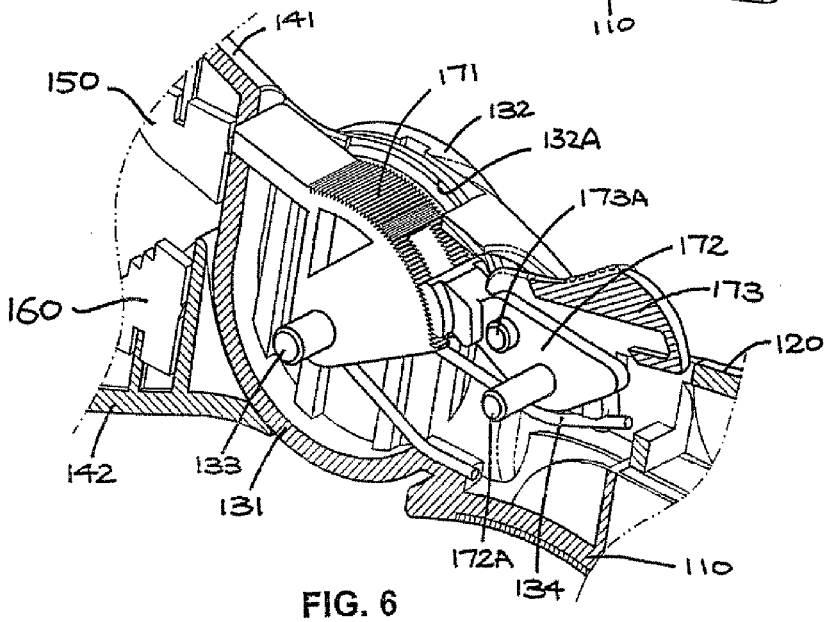
FIG. 6 is a fragmentary cross-sectional perspective view of a middle hinge portion of the jar opener of FIG. 1.

The pivot formation 131 of the first body half 110/141 includes a ratchet sector 170 (see FIGS. 4 and 6) which is fixed relative to this body half 110/141 and is integral with the pivot pin 133. The sector 170 has a part-cylindrical outer surface bearing a series of skew or asymmetrical teeth 171 which is exposed for ratchet engagement through a slot 132A (see FIG. 6) in the wall of the pivot formation 132.

The ratchet sector 170 co-operates with a spring-loaded pawl 172 to implement a locking mechanism for locking the jaws 150 and 160 as close as possible to maintain grip on a lid, such that a user of the jar opener 100 may concentrate on turning to loosen or unscrew the lid.

The pawl 172 is supported internally by the second handle 120 about an axle 172A for slight pivotal movement, with its serrated tip engaging upon the teeth 171 of the sector 170 through the slot 132A for ratchet action with the teeth 171. The pawl 172 is resiliently urged against the teeth 171 by an adjacent limb of the spring 134, which acts upon the pawl 172 via a knob 173 that covers the pawl 172. Whilst this limb of the spring 134 acts upon the second handle 120 indirectly via the knob 173 and pawl 172, the other limb acts directly upon the first handle 110. The knob 173 is mounted on the pawl 172 about a shorter axle 173A for limited pivotal movement relative thereto.

Figure 7:
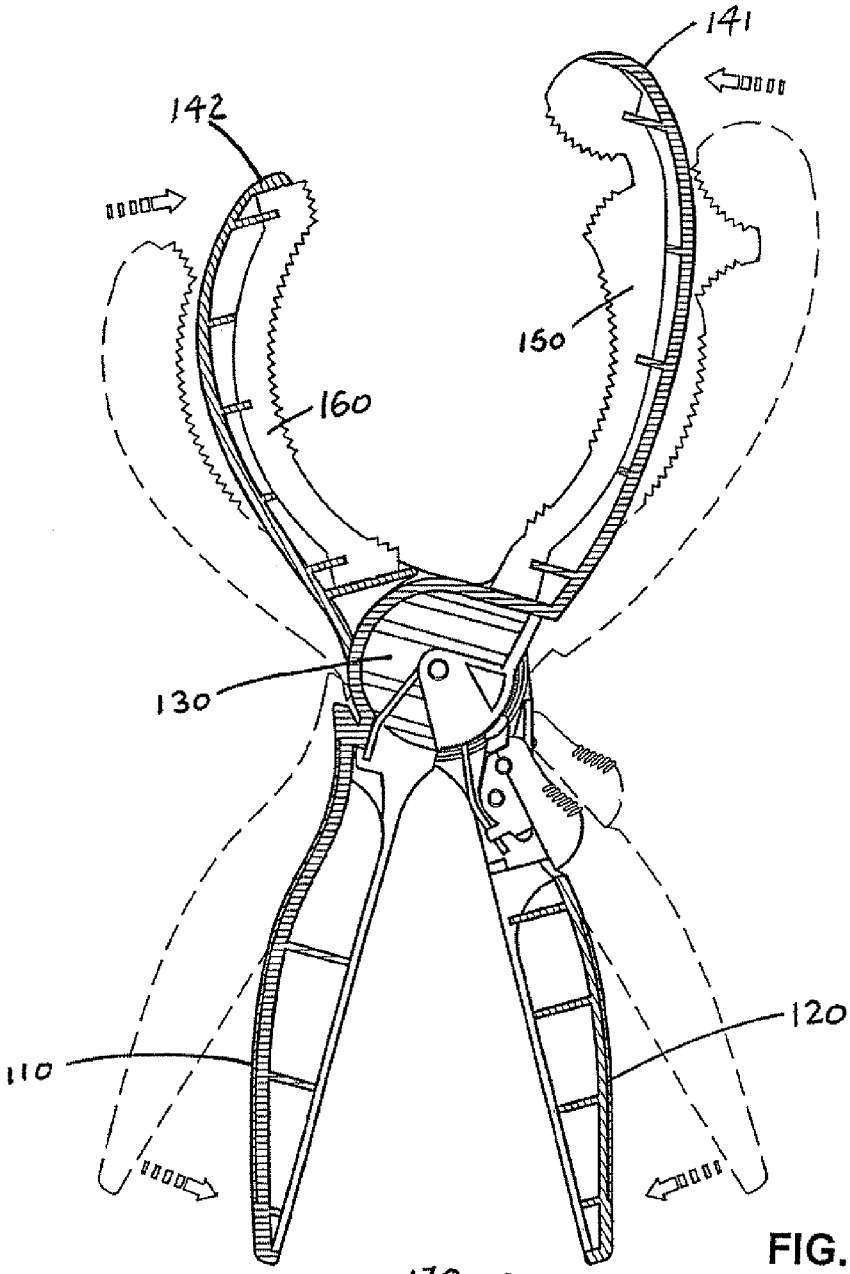
FIG. 7 is a cross-sectional plan view of the jar opener of FIG. 1, showing its two parts pivotable like a pair of pliers.
Figure 8:
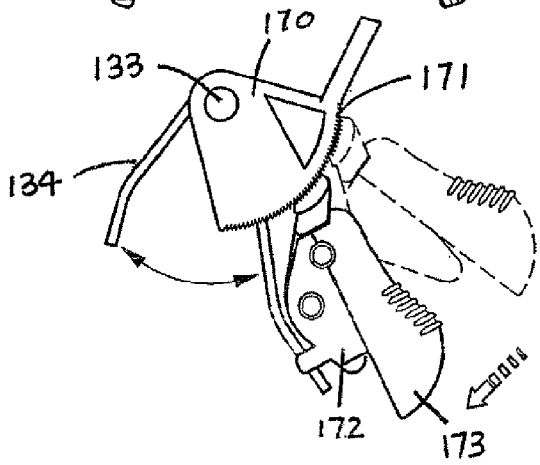
FIG. 8 is a plan view of a locking mechanism of the jar opener of FIG. 7.
Figure 9:
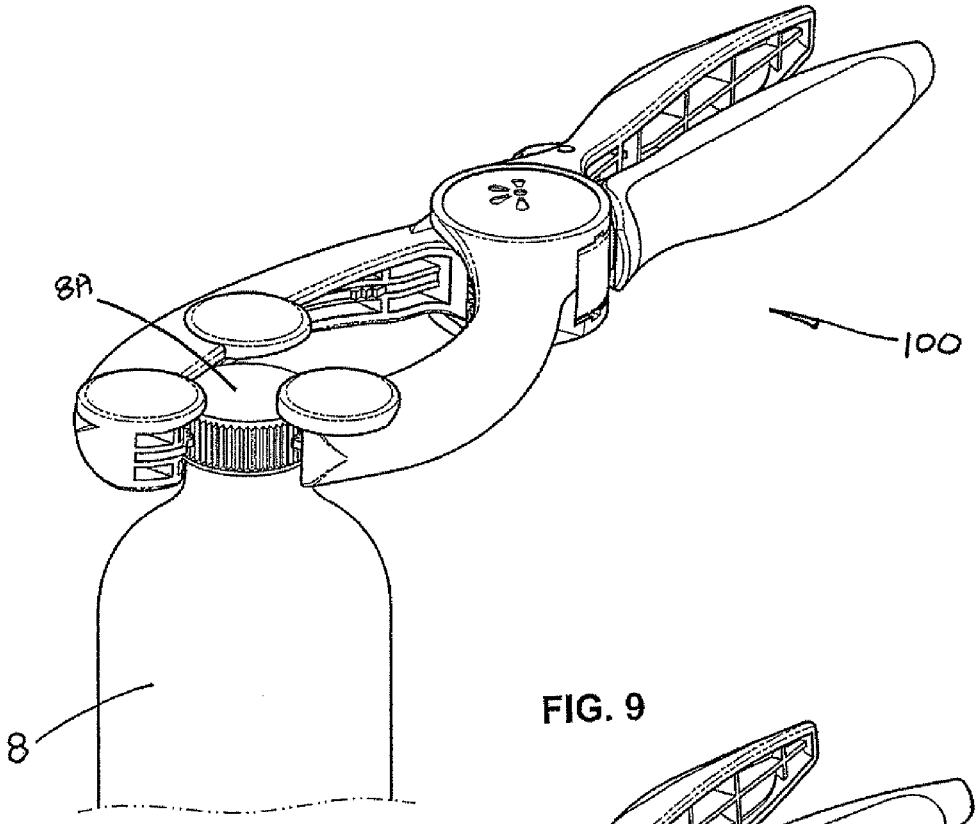
FIG. 9 is a perspective view illustrating the use of the jar opener of FIG. 1 to open the cap of a bottle.
Figure 10:
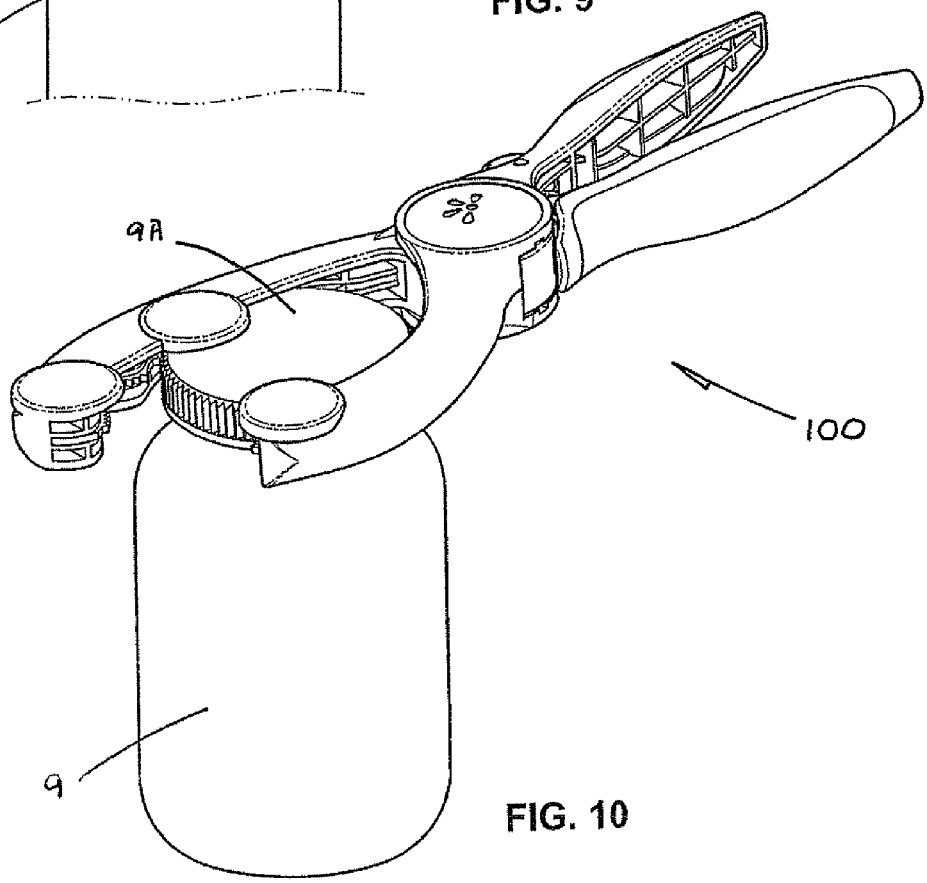
FIG. 10 is another perspective view illustrating the use of the jar opener of FIG. 1 to open the lid of a jar.
Figure 11:
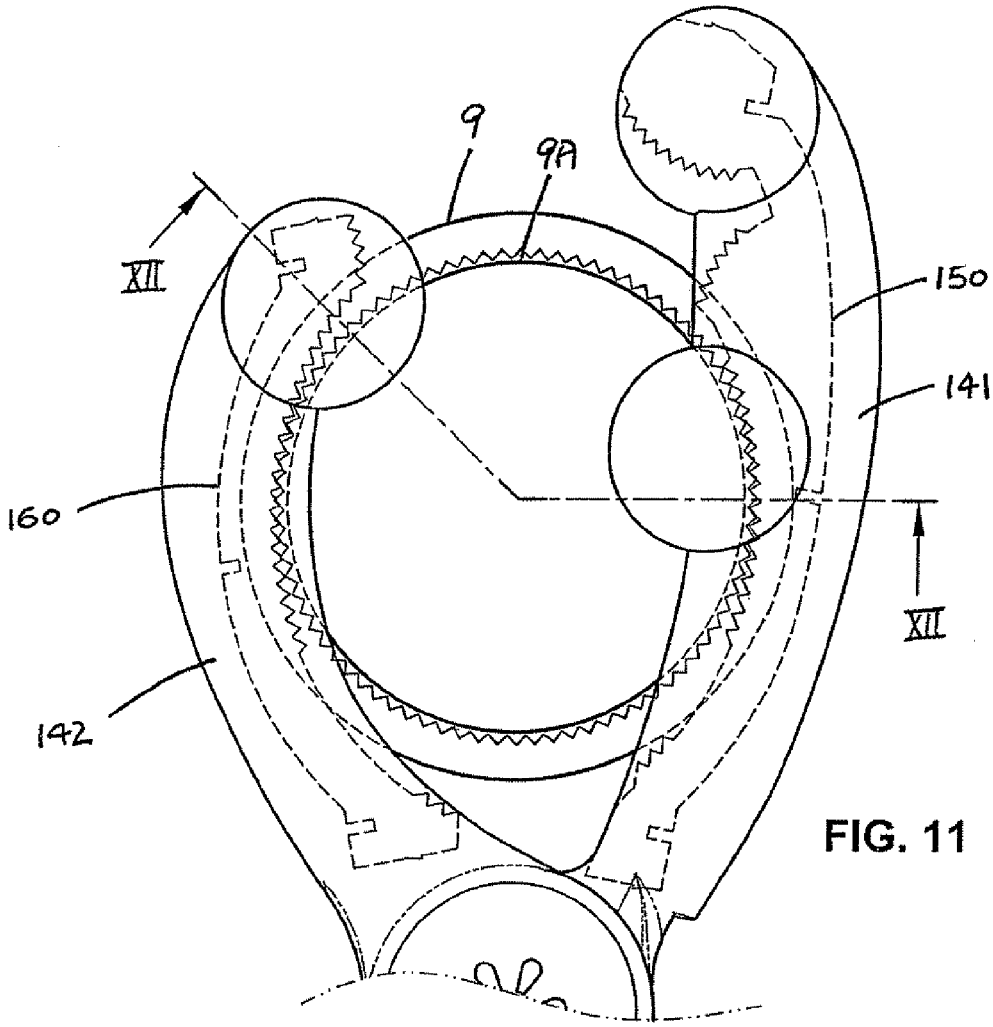
FIG. 11 is a fragmentary plan view of the jar opener and the jar and lid of FIG. 10.
Figure 12:
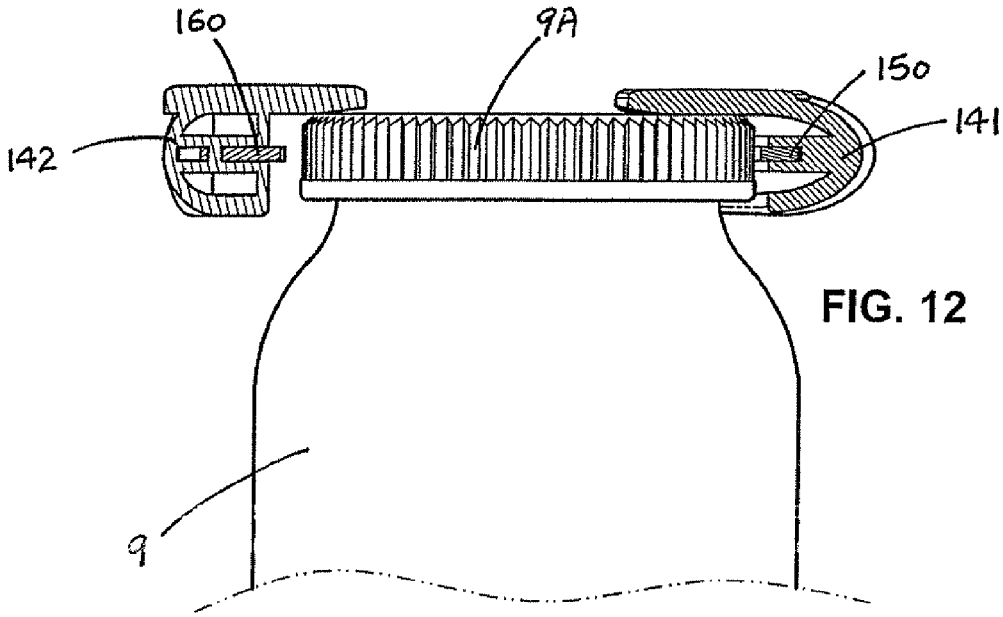
FIG. 12 is a fragmentary cross-sectional side view of the jar opener and the jar and lid of FIG. 11, taken along line XII-XII.

As the jaws 150 and 160 are pivoted close towards each other by the handles 110 and 120 (FIG. 7), the pawl 172 on the second handle 120 sweeps downwardly past the teeth 171 of the ratchet sector 170 fixed to the first handle 110 (FIG. 8). When released the handles 110 and 120 tend to pivot apart by the spring 134, but upon the tendency to move in the opposite direction the pawl 172 immediately interlocks with the teeth 171 under the action of the same spring 134 to counteract any such revered pivoting of the handles 110 and 120, whereby the jaws 150 and 160 are locked gripping tight upon the lid.

The handles 110 and 120 may be unlocked by pressing the knob 173, which then holds back the force of the spring 134 to allow slight retreat and hence disengagement of the pawl 172 from the teeth 171 of the ratchet sector 170. This allows the handles 110 and 120 to be immediately sprung apart by the spring 134, and hence the jaws 150 and 160 to let go the lid.

The jaws 150 and 160 of the jar opener 100 are designed to fit lids of jars, as well as caps of bottles that are equivalent but usually smaller, of a wide range of diameters. More specifically, the jaws 150 and 160 have a pair of inner gripping portions 151 and 161 for gripping lids of relatively larger diameters and a pair of outer gripping portions 152 and 162 for gripping lids or caps of relatively smaller diameters. The inner gripping portions 151 and 161 are situated adjacent the pivot 130, whilst the outer gripping portions 152 and 162 are located adjacent the inner gripping portions 151 and 161 and away from the pivot 130, at the tips of the jaws 150 and 160.

Figure 16:
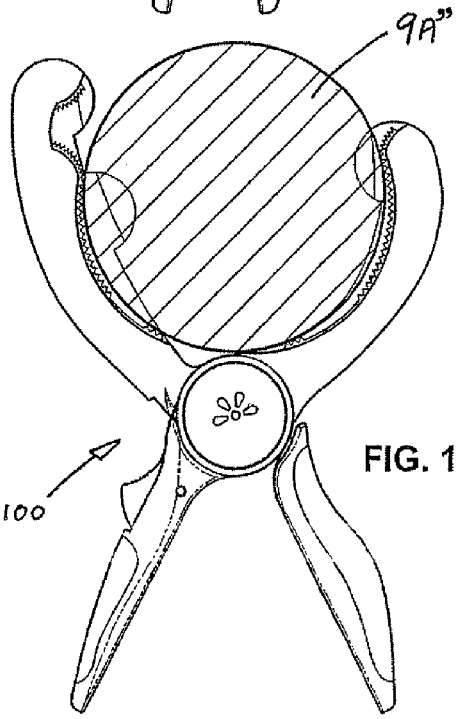

The inner gripping portions 151 and 161 have respective concave profiles facing each other, which have closely similar shapes or curvatures. FIGS. 13 to 16 illustrate how these gripping portions 151 and 161 perform gripping on lids 9A of jars 9 of different diameters. By reason of the substantial symmetry between the two gripping profiles, large and small lids 9A that fit are clamped centrally, i.e. being gripped on diametrically opposite sides thereof, for the most stable grip, except the largest lid 9A" as shown in FIG. 16 which cannot quite sufficiently fit in but the grip is still sound.

The outer gripping portions 152 and 162 have two parts 152A and 152B on the first jaw 150 and one, third part 162A on the second jaw 160 facing in a direction generally halfway between the two parts 152A and 152B, together providing a non-obtuse triangular three-point grip.

Each of the two parts 152A and 152B on the first jaw 150 has a convex profile, and they are positioned in V-shaped arrangement diverging curvedly outwardly. The outer part 152A is situated right at the tip of the jaw 150, whilst the other part 152B adjoins an outer end 151' of the concave profile of the inner gripping portion 151 on the same jaw 150. The third part 162A on the second jaw 160 also has a convex profile, and it adjoins an outer end 161' of the concave profile of the inner gripping portion 161 on the same jaw 160.

Figure 13:
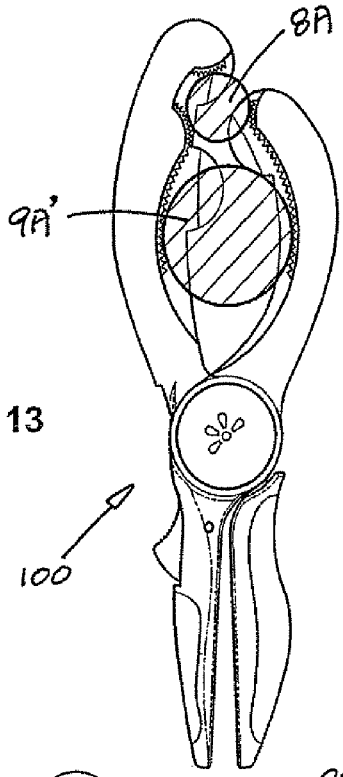
FIGS. 13 to 16 are plan views showing the use of the jar opener of FIG. 1 on caps and lids of various sizes.
Figure 14:
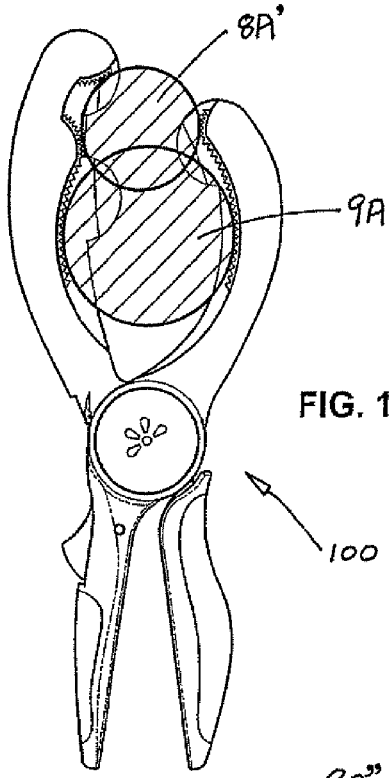
Figure 15:
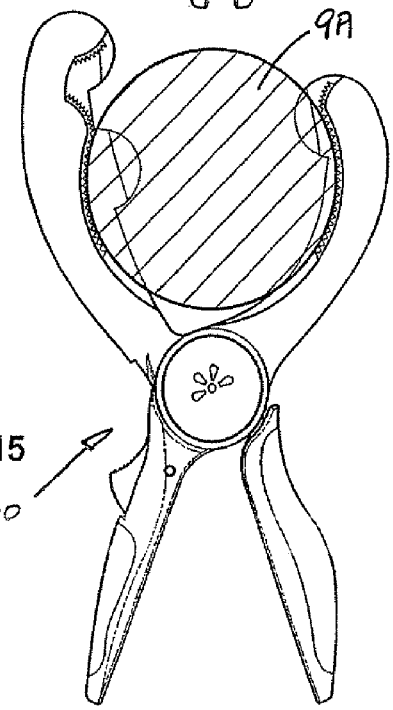

The non-obtuse triangular arrangement of the three parts 152A, 152B and 162A of the outer gripping portions 152 and 162 is made for gripping smaller lids and in particular caps 8A of bottles 8, as illustrated in FIGS. 13 and 14. Within a certain limited range of angles between the two jaws 150 and 160, the third part 162A will stay facing generally halfway between the other two parts 152A and 152B such that the three points of their grip will remain acute triangular for stability. Cap 8A' is about the largest cap that can be gripped reasonably tight by the tips of the jaws 150 and 160, and for wider caps or lids from say cap 9A' the inner gripping portions 151 and 161 should be used instead.

Whilst the inner gripping portions 151 and 161 are shaped for gripping larger lids, smaller lids or caps that are too small are catered for by the outer gripping portions 152 and 162 at the tips of the jaws 150 and 160. The provision of two sets of gripping portions 151/161 and 152/162 in the subject jar opener 100 broadens the range of different size of lids and caps that can be opened.

Gripping larger lids at a position adjacent or closest to the pivot 130 (by the inner gripping portions 151/161) is sensible because larger lids are often harder to loosen and hence a stronger grip is usually required. The arrangement of a three-point grip (by the outer gripping portions 152/162) at a position farther away from the pivot 130 has the advantage that the three gripping points will remain acute triangular, hence capable of providing a stable grip, even when the jaws 150 and 160 are pivoted wider apart.

The invention has been given by way of example only, and various modifications of and/or alterations to the described embodiment may be made by persons skilled in the art without departing from the scope of the invention as specified in the appended claims.

The invention claimed is:

1. An opener for opening containers with threaded closures, the opener comprising:

first and second handles;

a pivot connecting the first and second handles for pivotal movement relative to each other; and a head section comprising first and second jaws extending from the pivot, respectively integral with, extending from, and pivotable by the first and second handles to close the first and second jaws for gripping a threaded closure of a container and to open the first and second jaws for releasing the threaded closure of the container, wherein the first and second jaws comprise first and second concave inner gripping portions including respective first and second concave profiles that face each other and extend outwardly from and adjacent the pivot for gripping a threaded closure of a relatively large diameter, and first and second convex outer gripping portions respectively extending from and adjacent the first and second concave inner gripping portions, and more distant from the pivot than the first and second concave gripping portions, for gripping a threaded closure of a container of relatively small diameter, wherein the first convex outer gripping portion includes a pair of spaced-apart convex profiles, and the second convex outer gripping portion includes a single convex profile located between the pair of spaced-apart convex profiles of the first convex outer gripping portion when the first and second jaws are pivoted toward each other as far as possible, without an object located between the first and second jaws.

2. The opener as claimed in claim 1, wherein each of the concave profiles of the first and second concave inner gripping portions is serrated and each of the convex profiles of the first and second convex outer gripping portions is serrated.

3. The opener as claimed in claim 1 including a spring biasing the first and second handles to pivot apart from each other about the pivot.

4. An opener for opening containers with threaded closures, the opener comprising:

first and second handles;

a pivot connecting the first and second handles for pivotal movement relative to each other;

a head section comprising first and second jaws extending from the pivot, respectively integral with, extending from, and pivotable by the first and second handles to close the first and second jaws for gripping a threaded closure of a container and to open the first and second jaws for releasing the threaded closure of the container, wherein the first and second jaws comprise first and second concave inner gripping portions including respective first and second concave profiles that face each other and extend outwardly from adjacent the pivot for gripping a threaded closure of a relatively large diameter, and first and second convex outer gripping portions respectively extending from and adjacent the first and second concave inner gripping portions, and more distant from the pivot than the first and second concave gripping portions, for gripping a threaded closure of a container of relatively small diameter, wherein the first convex outer gripping portion includes a pair of spaced-apart convex profiles, and the second convex outer gripping portion includes a single convex profile located between the pair of spaced-apart convex profiles of the first convex outer gripping portion when the first and second jaws are pivoted toward each other as far as possible, without an object located between the first and second jaws;

a spring biasing the first and second handles to pivot apart from each other about the pivot; and a locking mechanism locking the first and second handles relative to each other to maintain a grip by the first and second jaws upon a threaded closure of a container, wherein the locking mechanism comprises a first member fixed relative to the first handle, and a second member movably supported by the second handle and biased by the spring to engage the first member, the first and second members being locked in position with respect to each other through a ratchet action, preventing the first and second handles from pivoting apart from each other.

* * * * *